United States Patent [19]

Ehrat

[11] Patent Number: 4,534,195

[45] Date of Patent: Aug. 13, 1985

[54] MECHANICAL LOCK HAVING A VARIABLE KEY

[75] Inventor: Kurt Ehrat, Steinmaur, Switzerland

[73] Assignee: GRETAG Aktiengesellschaft, Regensdorf, Switzerland

[21] Appl. No.: 464,940

[22] Filed: Feb. 8, 1983

[30] Foreign Application Priority Data

Feb. 19, 1982 [CH] Switzerland ..... 1048/82

[51] Int. Cl.[3] ..... E05B 37/00

[52] U.S. Cl. ..... 70/316; 70/324; 70/325; 70/411

[58] Field of Search ..... 70/411, 382, 383, 392, 70/316, 317, 324, 325

[56] References Cited

U.S. PATENT DOCUMENTS

| | | | |
|---|---|---|---|
| 1,050,741 | 1/1913 | Lowrie | 70/324 |
| 1,158,152 | 10/1915 | Albanese | 70/324 |
| 1,252,606 | 1/1918 | Neubauer | 70/411 |
| 1,391,359 | 9/1921 | Baer | 70/324 |
| 1,994,960 | 3/1935 | Poderzaj | 70/312 |
| 3,124,951 | 3/1964 | Marik | 70/411 X |
| 3,423,972 | 1/1969 | Marti et al. | 70/317 X |
| 3,628,355 | 12/1971 | Zangrando | 70/324 X |
| 3,774,424 | 11/1973 | Ehrat | 70/383 |
| 4,030,325 | 6/1977 | Ehrat | 70/383 |

FOREIGN PATENT DOCUMENTS

| | | | |
|---|---|---|---|
| 289447 | 11/1963 | Australia | 70/411 |

*Primary Examiner*—Gary L. Smith
*Assistant Examiner*—Thomas J. Dubnicka
*Attorney, Agent, or Firm*—Burns, Doane, Swecker & Mathis

[57] ABSTRACT

The present invention relates to a lock having a key provided with variable key information elements which are adapted to be scanned during rotation of the key around an axis of the lock. The key preferably includes ten (10) cam plates fixedly joined together in pairs for rotation and mounted in pairs on coaxial hollow shafts. Each shaft is driven by a handwheel in an angularly variable manner. Each cam plate has five (5) different radial steps, so that each pair of cam plates correspondingly has twenty-five (25) different possible combinations of angular positions, each of which can be identified by a letter of the alphabet on the respective handwheel. The key combination is legible through a display window. The lock and its key which are of a relatively simple design, allow the key combination to be easily set and readily recalled.

13 Claims, 4 Drawing Figures

MECHANICAL LOCK HAVING A VARIABLE KEY

BACKGROUND AND SUMMARY OF THE INVENTION

The present invention relates to a mechanical lock having a key provided with variable key information elements which are adapted to be scanned during rotation of the key around an axis of the lock.

U.S. Pat. No. 4,030,325 discloses an adaptive lock which may be programmed by certain manipulations for any key of a given plurality of keys. The advantages of such an adaptive lock are more pronounced if the corresponding keys are themselves variable or adjustable. While the aforementioned U.S. Pat. No. 4,030,325 describes such a variable key, that key is complex in its design, expensive to produce, and relatively cumbersome to adjust. Furthermore, it is relatively difficult to remember the various key information for the key combination with this type of key.

An object of the present invention is to provide a mechanical lock having a variable key which overcomes the difficulties of the prior art.

It is a further object of the present invention to provide a mechanical lock having a variable key that is relatively simple in its design.

Another object of the present invention is to provide a mechanical lock having a variable key which may be easily adjusted.

Another object of the present invention is to provide a mechanical lock having a variable key in which the key or the lock combination may be easily remembered.

These objects and others are achieved by the present invention with a mechanical lock having a key equipped with variable key information elements which are each in the form of a cam plate. The cam plates are coaxially located relative to the axis of the lock and are discretely adjustable with respect to a reference plane to individual angular positions. The cam plates have a plurality of different radii which determine multiple variations of key information per information element in the individual angular positions.

BRIEF DESCRIPTION OF THE DRAWINGS

A preferred embodiment of the present invention is described with reference to the following drawings wherein like elements bear like reference numerals and wherein.

DETAILED DESCRIPTION OF THE PREFERRED EMBODIMENT

Figure 1:
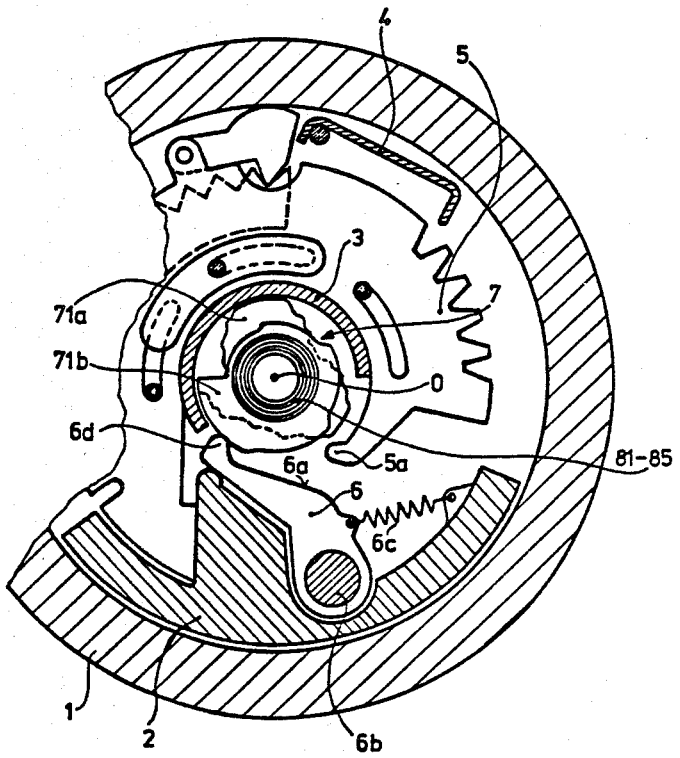
FIG. 1 is a partially broken cross-sectional view of the lock taken perpendicularly to the axis of the lock.

With reference to FIG. 1, the variable key in the present invention may be used in conjunction with a mechanical lock as described in U.S. Pat. No. 4,030,325, herein incorporated by reference. Briefly, the lock includes a housing or stator 1 having a main rotor 2, an auxiliary rotor 3, and a latching element 4. A plurality (for example, ten) of key sensing elements 5 are arranged in axial succession with respect to each other. An identical number of transmission elements 6 cooperate with the sensing elements 5. A key 7 is fixedly mounted in the lock to the main rotor and capable of rotation around a lock axis 0.

During rotational motion of the key 7 in an opening or closing process of the lock, scanning fingers 5*a* on the sensing elements 5 are in contact with scanning surfaces 6*a* of the associated transmission elements 6. The scanning surfaces 6*a* scan through the transmission elements 6 the key information contained on the key 7 in a spatial mechanical form. The transmission elements 6 are pivotally mounted by a bolt 6*b* in the main rotor 2 and each transmission element 6 is urged by a spring 6*c* against the key 7. Scanning noses 6*d* located at ends of the transmission elements 6 scan cam plates 71*a*, 71*b* . . . 75*a*, 75*b* (FIG. 2) formed on the key 7, which cam plates provide the key information.

The configuration and cooperation of the remaining parts of the lock, together with the operation of the lock are explained in detail in the aforementioned U.S. Pat. No. 4,030,325 and are thus not repeated herein. However, it is noted that except for the configuration of the key, the only difference with respect to the aforesaid U.S. Pat. No. 4,030,325 and the present invention is that in the former, the key is scanned directly by sensing elements 5, while in the present invention, the scanning is effected indirectly through the transmission elements 6.

Figure 2:
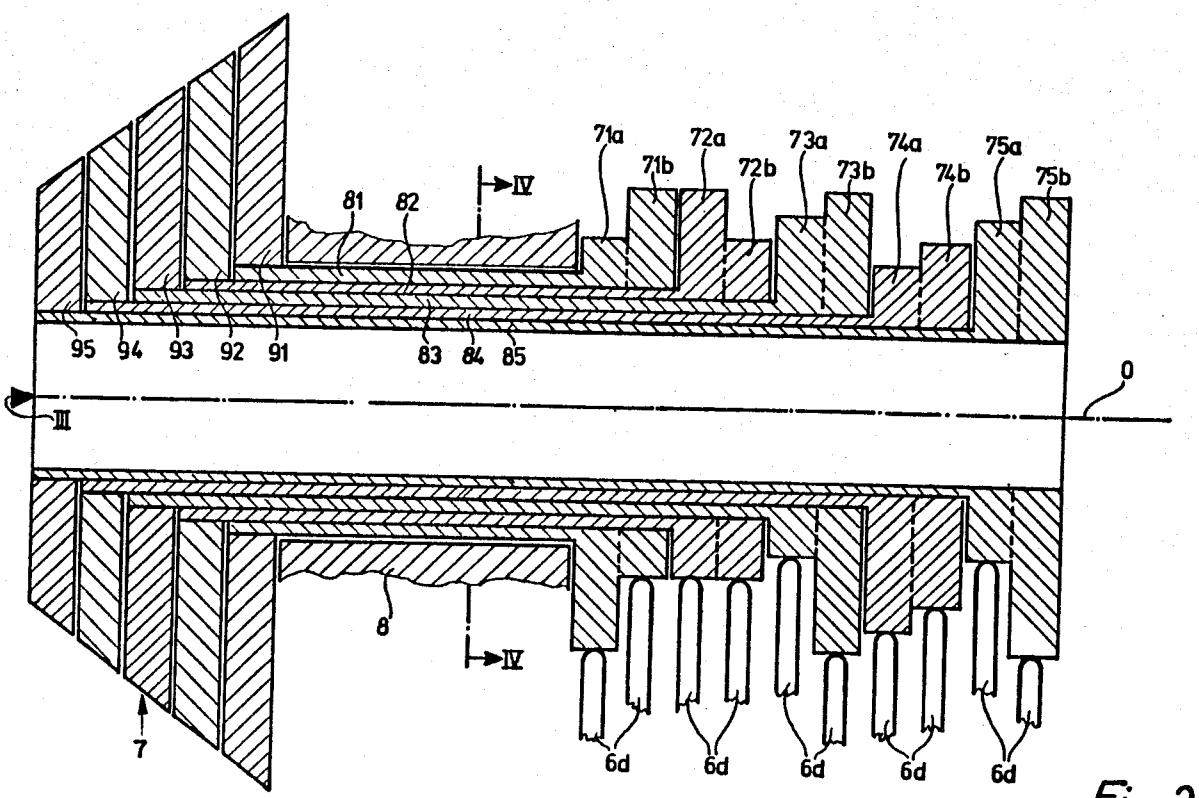
FIG. 2 is an axial sectional view through the key.

With reference to FIG. 2, the key 7 of the present invention is rotatably mounted in a front wall 8 of the lock. The key 7 includes a plurality (for example, 10) of cam plates 71*a*, 71*b* . . . 75*a*, 75*b* arranged in axial succession with respect to each other. The cam plates are fixedly joined together in pairs so that each pair rotates as a single unit. The pairs of cam plates are mounted on coaxial hollow shafts 81–85 which pass through the front wall 8 of the lock. Each shaft 81–85 is equipped outside of the lock with handwheels 91–95, respectively, which permit the individual cam plate pairs to be arbitrarily rotated with respect to each other.

Figure 4:
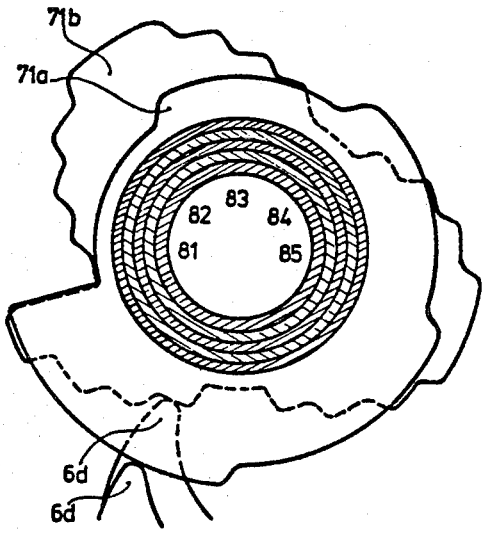
FIG. 4 is a cross-sectional view of the key along the line IV—IV of FIG. 2.

Each of the cam plates forms a key information element having five different discrete radial levels (FIG. 4) which are scanned by the scanning noses 6*d* of the transmission elements 6. Consequently, five to the second power ($5^2$) or five multiplied by five radial combinations are possible per pair of cam plates. Correspondingly, each pair of cam plates may be moved into twenty five discrete angular positions relative to a reference plane which, for example, may be the plane of the drawing in FIG. 2. Therefore, in each angular position, a different radial combination or combination of information elements is scanned. With the five pairs of cam plates shown, the total number of possible variations of the overall key combination amounts to five to the tenth power ($5^{10}$)which is adequate in practice for most applications.

It is evident to one skilled in the art that the number of radial levels or steps need not be restricted. Likewise, it is not a necessary condition that two cam plates are fixedly joined tooether for rotation. It is highly desirable that each cam plate or combination of plates be capable of the same approximate number of angular positions with different radii or combinations of radii as the approximate number of letters in an alphabet. This arrangement makes it possible to identify the individual angular positions by the letters of the alphabet. Further, relatively few letters are required for the entire key combination. Since the entire alphabet is available for each of the angular positions, the key combination may be easily chosen to obtain meaningful words, thereby substantially facilitating recall of the key combination.

Figure 3:
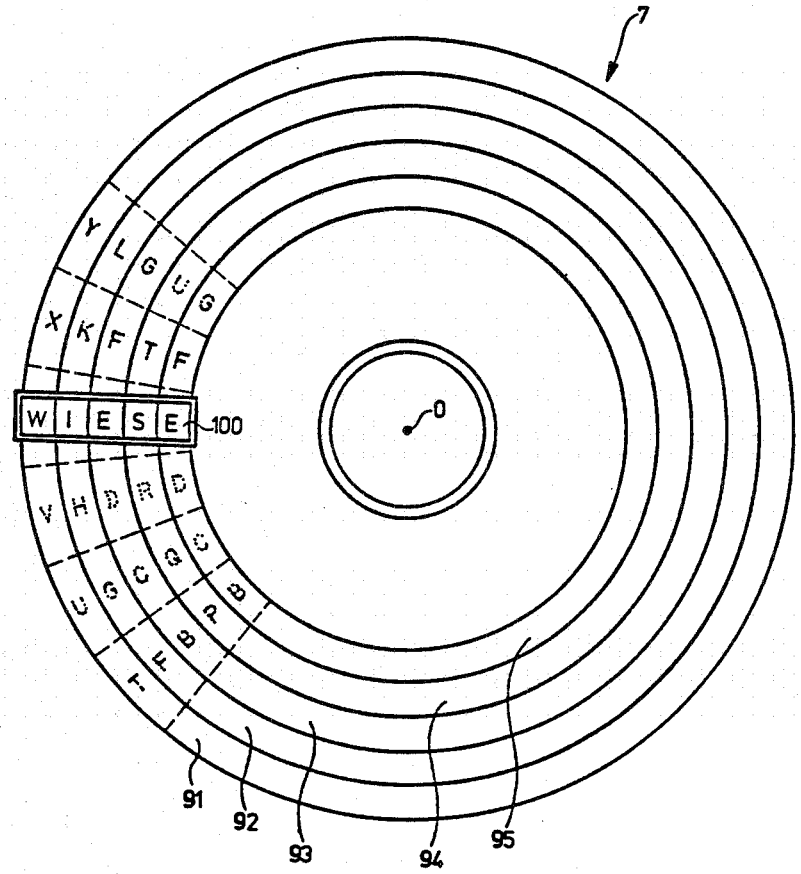
FIG. 3 is a view of the key in the direction of arrow III in FIG. 2.

With reference to FIG. 3, individual angular positions of the pairs of cam plates 71*a*, 71*b* . . . 75*a*, 75*b* are identified by letters applied to the circumference of the front surfaces of the handwheels 91–95. The key combination set is visible through a display window 100.

In the present case, as mentioned herein above, the key 7 is fixedly mounted in the lock, so that the lock is operating in the manner of a combination lock. Alternatively, it is possible to design the key 7 and the lock so that the key is removable and insertable, whereupon the lock is operating as a conventional lock with the insertion of a key. Therefore, a "key" is defined for purposes of the present invention as the fixedly installed or insertable part containing the (variable) key information which is scanned in the lock itself and compared with the key combination present therein.

The adaptive lock disclosed in U.S. Pat. No. 4,030,325 and herein incorporated by reference, has a lock combination which may be set to any arbitrary key information by simple manipulation with the key. The mode of functioning and operation of setting the combination for such a lock is described in detail in the aforementioned U.S. Pat. No. 4,030,325 and is identical in the lock of the present invention.

In the preferred embodiment described with reference to FIG. 2, each of the pairs of cam plates 71*a*, 71*b* . . . 75*a*, 75*b* is driven by its own handwheel 91–95. The drive or the angular displacement of the pairs of cam plates may alternatively be effected by other devices, such as a single handwheel or the like.

The present invention thus provides a mechanical lock and variable key which facilitates the ready recall of the key or lock combination and the convenient and easily verified setting of the key information or combination. The mechanical lock and variable key of the present invention also provide for extremely simple resetting of the lock combination in the case of an adaptive lock. Also, the possibility of acoustic detection of the lock combination set is practically nonexistent as a result of the indirect scanning employed within the lock.

The principles, preferred embodiments and modes of operation of the present invention have been described in the foregoing specification. The invention which is intended to be protected herein, however, is not to be construed as limited to the particular embodiments disclosed, since these are to be regarded as illustrative rather than restrictive. Variations and changes may be made by those skilled in the art without departing from the spirit of the invention.

What is claimed is:

1. A mechanical lock comprising a key having variable key information elements to be scanned during rotation of the key around the axis of the lock, each of the key information elements being in the form of a cam plate coaxially located relative to the axis of the lock, said cam plate discretely adjustable to individual angular positions, said cam plates each having a surface portion and a plurality of stepped portions of different radii for determining the multiple variation of key information per information element in the individual angular positions.

2. The lock as recited in claim 1 wherein the number of individual angular positions of each cam plate is at least twenty.

3. The lock as recited in claim 1, wherein two cam plates are fixedly joined together for rotation as a single unit.

4. The lock as recited in claim 2, wherein two cam plates are fixedly joined together for rotation as a single unit.

5. The lock as recited in claim 3, wherein each one of the joined cam plates has five different radial steps whereby twenty-five different angular positions of the unit are possible.

6. The lock as recited in claim 1, wherein the cam plates are fixedly arranged on coaxial hollow shafts for rotation therewith, said shafts having means for displacing the cam plates.

7. The lock as recited in claim 6, wherein the means for displacing the cam plates on the shafts includes handwheels at an end of each of the shafts.

8. The lock as recited in claim 1, further comprising means for displaying the instantaneous angular positions of the cam plates.

9. The lock as recited in claim 2, wherein each angular position of the cam plates is identified by a letter of the alphabet.

10. The lock as recited in claim 8, wherein each of the angular positions of the cam plates is identified by a letter of an alphabet.

11. The lock as recited in claim 1, wherein the key is fixedly installed in the lock.

12. The lock as recited in claim 1, wherein the lock has the configuration of an adaptive lock with a lock combination that is variable.

13. The lock as recited in claim 1, further comprising a transmission element for scanning the cam plates, the transmission element being arranged in active contact with a scanning element solely by rotation of the key.

* * * * *